US010186190B2

(12) United States Patent
Chaji et al.

(10) Patent No.: US 10,186,190 B2
(45) **Date of Patent: *Jan. 22, 2019**

(54) CORRECTION FOR LOCALIZED PHENOMENA IN AN IMAGE ARRAY

(71) Applicant: Ignis Innovation Inc., Waterloo (CA)

(72) Inventors: Gholamreza Chaji, Waterloo (CA); Mehdi Torbatian, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/675,297

(22) Filed: Aug. 11, 2017

(65) Prior Publication Data

US 2017/0345364 A1 Nov. 30, 2017

Related U.S. Application Data

(63) Continuation of application No. 14/561,697, filed on Dec. 5, 2014.

(Continued)

(51) Int. Cl.

| | |
|---|---|
| ***G09G 3/32*** | (2016.01) |
| ***G09G 3/3208*** | (2016.01) |
| ***G09G 3/3225*** | (2016.01) |

(52) U.S. Cl.

CPC ..... *G09G 3/3208* (2013.01); *G09G 3/3225* (2013.01); *G09G 2300/0413* (2013.01);

(Continued)

(58) Field of Classification Search

CPC ..... G09G 3/2092; G09G 3/22; G09G 3/2944; G09G 3/30; G09G 3/3614; G09G 3/3655

See application file for complete search history.

(56) References Cited

U.S. PATENT DOCUMENTS 3,506,851 A 4/1970 Polkinghorn
3,774,055 A 11/1973 Bapat (Continued)

FOREIGN PATENT DOCUMENTS

CA 1 294 034 1/1992
CA 2 109 951 11/1992

(Continued)

OTHER PUBLICATIONS

Ahnood : "Effect of threshold voltage instability on field effect mobility in thin film transistors deduced from constant current measurements"; dated Aug. 2009.

(Continued)

*Primary Examiner* — Olga Merkoulova

(74) *Attorney, Agent, or Firm* — Stratford Managers Corporation

(57) ABSTRACT

A method and system of compensating for localized phenomena in a display is disclosed. The display includes an array of pixels and a control system for adjusting content data signals for the array of pixels to compensate for aging of the pixels in the array. The control system measures a parameter of at least one of the pixels in the array via a read input of the at least one of the pixels. The controller determines the effect of the localized phenomena on the pixel using the parameter. A characteristic is measured for at least one of the pixels in the array via the read input of the at least one of the pixels. The measured characteristic is adjusted to reduce the effect of the localized phenomena. An adjusted aging compensation value based on the adjusted measured characteristic is calculated by the controller. The aging compensation value is applied to a data content signal to at least one of the pixels.

20 Claims, 6 Drawing Sheets

Related U.S. Application Data

(60) Provisional application No. 61/912,926, filed on Dec. 6, 2013.

(52) U.S. Cl.
CPC ..... *G09G 2300/0819* (2013.01); *G09G 2320/029* (2013.01); *G09G 2320/0233* (2013.01); *G09G 2320/0285* (2013.01); *G09G 2320/041* (2013.01); *G09G 2320/043* (2013.01); *G09G 2320/045* (2013.01)

(56) References Cited

U.S. PATENT DOCUMENTS 4,090,096 A 5/1978 Nagami
4,160,934 A 7/1979 Kirsch
4,295,091 A 10/1981 Ponkala
4,354,162 A 10/1982 Wright
4,943,956 A 7/1990 Noro
4,996,523 A 2/1991 Bell
5,153,420 A 10/1992 Hack
5,198,803 A 3/1993 Shie
5,204,661 A 4/1993 Hack
5,266,515 A 11/1993 Robb
5,489,918 A 2/1996 Mosier
5,498,880 A 3/1996 Lee
5,557,342 A 9/1996 Eto
5,561,381 A 10/1996 Jenkins
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,684,365 A 11/1997 Tang
5,691,783 A 11/1997 Numao
5,714,968 A 2/1998 Ikeda
5,723,950 A 3/1998 Wei
5,744,824 A 4/1998 Kousai
5,745,660 A 4/1998 Kolpatzik
5,748,160 A 5/1998 Shieh
5,815,303 A 9/1998 Berlin
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,923,794 A 7/1999 McGrath
5,945,972 A 8/1999 Okumura
5,949,398 A 9/1999 Kim
5,952,789 A 9/1999 Stewart
5,952,991 A 9/1999 Akiyama
5,982,104 A 11/1999 Sasaki
5,990,629 A 11/1999 Yamada
6,023,259 A 2/2000 Howard
6,069,365 A 5/2000 Chow
6,091,203 A 7/2000 Kawashima
6,097,360 A 8/2000 Holloman
6,144,222 A 11/2000 Ho
6,177,915 B1 1/2001 Beeteson
6,229,506 B1 5/2001 Dawson
6,229,508 B1 5/2001 Kane
6,246,180 B1 6/2001 Nishigaki
6,252,248 B1 6/2001 Sano
6,259,424 B1 7/2001 Kurogane
6,262,589 B1 7/2001 Tamukai
6,271,825 B1 8/2001 Greene
6,288,696 B1 9/2001 Holloman
6,304,039 B1 10/2001 Appelberg
6,307,322 B1 10/2001 Dawson
6,310,962 B1 10/2001 Chung
6,320,325 B1 11/2001 Cok
6,323,631 B1 11/2001 Juang
6,329,971 B2 12/2001 McKnight
6,356,029 B1 3/2002 Hunter
6,373,454 B1 4/2002 Knapp
6,377,237 B1 4/2002 Sojourner
6,392,617 B1 5/2002 Gleason
6,404,139 B1 6/2002 Sasaki
6,414,661 B1 7/2002 Shen
6,417,825 B1 7/2002 Stewart
6,433,488 B1 8/2002 Bu
6,437,106 B1 8/2002 Stoner
6,445,369 B1 9/2002 Yang
6,475,845 B2 11/2002 Kimura
6,501,098 B2 12/2002 Yamazaki
6,501,466 B1 12/2002 Yamagishi
6,518,962 B2 2/2003 Kimura
6,522,315 B2 2/2003 Ozawa
6,525,683 B1 2/2003 Gu
6,531,827 B2 3/2003 Kawashima
6,541,921 B1 4/2003 Luciano, Jr.
6,542,138 B1 4/2003 Shannon
6,555,420 B1 4/2003 Yamazaki
6,577,302 B2 6/2003 Hunter
6,580,408 B1 6/2003 Bae
6,580,657 B2 6/2003 Sanford
6,583,398 B2 6/2003 Harkin
6,583,775 B1 6/2003 Sekiya
6,594,606 B2 7/2003 Everitt
6,618,030 B2 9/2003 Kane
6,639,244 B1 10/2003 Yamazaki
6,668,645 B1 12/2003 Gilmour
6,677,713 B1 1/2004 Sung
6,680,580 B1 1/2004 Sung
6,687,266 B1 2/2004 Ma
6,690,000 B1 2/2004 Muramatsu
6,690,344 B1 2/2004 Takeuchi
6,693,388 B2 2/2004 Oomura
6,693,610 B2 2/2004 Shannon
6,697,057 B2 2/2004 Koyama
6,720,942 B2 4/2004 Lee
6,724,151 B2 4/2004 Yoo
6,734,636 B2 5/2004 Sanford
6,738,034 B2 5/2004 Kaneko
6,738,035 B1 5/2004 Fan
6,753,655 B2 6/2004 Shih
6,753,834 B2 6/2004 Mikami
6,756,741 B2 6/2004 Li
6,756,952 B1 6/2004 Decaux
6,756,958 B2 6/2004 Furuhashi
6,765,549 B1 7/2004 Yamazaki
6,771,028 B1 8/2004 Winters
6,777,712 B2 8/2004 Sanford
6,777,888 B2 8/2004 Kondo
6,781,567 B2 8/2004 Kimura
6,806,497 B2 10/2004 Jo
6,806,638 B2 10/2004 Lih
6,806,857 B2 10/2004 Sempel
6,809,706 B2 10/2004 Shimoda
6,815,975 B2 11/2004 Nara
6,828,950 B2 12/2004 Koyama
6,853,371 B2 2/2005 Miyajima
6,859,193 B1 2/2005 Yumoto
6,873,117 B2 3/2005 Ishizuka
6,876,346 B2 4/2005 Anzai
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura
6,940,214 B1 9/2005 Komiya
6,943,500 B2 9/2005 LeChevalier
6,947,022 B2 9/2005 McCartney
6,954,194 B2 10/2005 Matsumoto
6,956,547 B2 10/2005 Bae
6,975,142 B2 12/2005 Azami
6,975,332 B2 12/2005 Arnold

(56) References Cited

U.S. PATENT DOCUMENTS 6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,053,875 B2 5/2006 Chou
7,057,359 B2 6/2006 Hung
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Change
7,116,058 B2 10/2006 Lo
7,119,493 B2 10/2006 Fryer
7,122,835 B1 10/2006 Ikeda
7,127,380 B1 10/2006 Iverson
7,129,914 B2 10/2006 Knapp
7,161,566 B2 1/2007 Cok
7,164,417 B2 1/2007 Cok
7,193,589 B2 3/2007 Yoshida
7,224,332 B2 5/2007 Cok
7,227,519 B1 6/2007 Kawase
7,245,277 B2 7/2007 Ishizuka
7,246,912 B2 7/2007 Burger
7,248,236 B2 7/2007 Nathan
7,262,753 B2 8/2007 Tanghe
7,274,363 B2 9/2007 Ishizuka
7,310,092 B2 12/2007 Imamura
7,315,295 B2 1/2008 Kimura
7,321,348 B2 1/2008 Cok
7,339,560 B2 3/2008 Sun
7,355,574 B1 4/2008 Leon
7,358,941 B2 4/2008 Ono
7,368,868 B2 5/2008 Sakamoto
7,397,485 B2 7/2008 Miller
7,411,571 B2 8/2008 Huh
7,414,600 B2 8/2008 Nathan
7,423,617 B2 9/2008 Giraldo
7,453,054 B2 11/2008 Lee
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,605,792 B2 10/2009 Son
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,675,485 B2 3/2010 Steer
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,924,249 B2 4/2011 Nathan
7,932,883 B2 4/2011 Klompenhouwer
7,969,390 B2 6/2011 Yoshida
7,978,187 B2 7/2011 Nathan
7,994,712 B2 8/2011 Sung
8,026,876 B2 9/2011 Nathan
8,031,180 B2 10/2011 Miyamoto
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,294,696 B2 10/2012 Min
8,314,783 B2 11/2012 Sambandan
8,339,386 B2 12/2012 Leon
8,441,206 B2 5/2013 Myers
8,493,296 B2 7/2013 Ogawa
8,581,809 B2 11/2013 Nathan
9,125,278 B2 9/2015 Nathan
9,368,063 B2 6/2016 Chaji
9,536,460 B2 1/2017 Chaji
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101152 A1 8/2002 Kimura
2002/0101172 A1 8/2002 Bu
2002/0105279 A1 8/2002 Kimura
2002/0117722 A1 8/2002 Osada
2002/0122308 A1 9/2002 Ikeda
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0169575 A1 11/2002 Everitt
2002/0180369 A1 12/2002 Koyama
2002/0180721 A1 12/2002 Kimura
2002/0181276 A1 12/2002 Yamazaki
2002/0183945 A1 12/2002 Everitt
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0107560 A1 6/2003 Yumoto
2003/0111966 A1 6/2003 Mikami
2003/0122745 A1 7/2003 Miyazawa
2003/0122749 A1 7/2003 Booth, Jr.
2003/0122813 A1 7/2003 Ishizuki
2003/0142088 A1 7/2003 LeChevalier
2003/0146897 A1 8/2003 Hunter
2003/0151569 A1 8/2003 Lee
2003/0156101 A1 8/2003 Le Chevalier

(56) References Cited

U.S. PATENT DOCUMENTS

2003/0169241 A1 9/2003 LeChevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin
2004/0032382 A1 2/2004 Cok
2004/0041750 A1 3/2004 Abe
2004/0066357 A1 4/2004 Kawasaki
2004/0070557 A1 4/2004 Asano
2004/0070565 A1 4/2004 Nayar
2004/0090186 A1 5/2004 Kanauchi
2004/0090400 A1 5/2004 Yoo
2004/0095297 A1 5/2004 Libsch
2004/0100427 A1 5/2004 Miyazawa
2004/0108518 A1 6/2004 Jo
2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174349 A1 9/2004 Libsch
2004/0174354 A1 9/2004 Ono
2004/0178743 A1 9/2004 Miller
2004/0183759 A1 9/2004 Stevenson
2004/0196275 A1 10/2004 Hattori
2004/0207615 A1 10/2004 Yumoto
2004/0227697 A1 11/2004 Mori
2004/0233125 A1 11/2004 Tanghe
2004/0239596 A1 12/2004 Ono
2004/0246246 A1 12/2004 Tobita
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0105031 A1 5/2005 Shih
2005/0110420 A1 5/2005 Arnold
2005/0110807 A1 5/2005 Chang
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0206590 A1 9/2005 Sasaki
2005/0212787 A1 9/2005 Noguchi
2005/0219184 A1 10/2005 Zehner
2005/0225683 A1 10/2005 Nozawa
2005/0248515 A1 11/2005 Naugler
2005/0269959 A1 12/2005 Uchino
2005/0269960 A1 12/2005 Ono
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007206 A1 1/2006 Reddy
2006/0007249 A1 1/2006 Reddy
2006/0012310 A1 1/2006 Chen
2006/0012311 A1 1/2006 Ogawa
2006/0015272 A1 1/2006 Giraldo
2006/0022305 A1 2/2006 Yamashita
2006/0022907 A1 2/2006 Uchino
2006/0027807 A1 2/2006 Nathan
2006/0030084 A1 2/2006 Young
2006/0038501 A1 2/2006 Koyama
2006/0038758 A1* 2/2006 Routley ..... G09G 3/3233 345/81
2006/0038762 A1 2/2006 Chou
2006/0044227 A1 3/2006 Hadcock
2006/0061248 A1 3/2006 Cok
2006/0066533 A1* 3/2006 Sato ..... G09G 3/20 345/76
2006/0077134 A1 4/2006 Hector
2006/0077135 A1 4/2006 Cok
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103324 A1 5/2006 Kim
2006/0103611 A1 5/2006 Choi
2006/0125740 A1 6/2006 Shirasaki
2006/0149493 A1 7/2006 Sambandan
2006/0170623 A1 8/2006 Naugler, Jr.
2006/0176250 A1 8/2006 Nathan
2006/0208961 A1* 9/2006 Nathan ..... G09G 3/3283 345/44
2006/0208971 A1 9/2006 Deane
2006/0214888 A1 9/2006 Schneider
2006/0231740 A1 10/2006 Kasai
2006/0232522 A1 10/2006 Roy
2006/0244697 A1 11/2006 Lee
2006/0256048 A1 11/2006 Fish
2006/0261841 A1 11/2006 Fish
2006/0273997 A1 12/2006 Nathan
2006/0279481 A1 12/2006 Haruna
2006/0284801 A1 12/2006 Yoon
2006/0284802 A1 12/2006 Kohno
2006/0284895 A1 12/2006 Marcu
2006/0290614 A1 12/2006 Nathan
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1* 1/2007 Bassetti ..... G09G 3/3233 345/173
2007/0057873 A1 3/2007 Uchino
2007/0057874 A1 3/2007 Le Roy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0097038 A1 5/2007 Yamazaki
2007/0097041 A1 5/2007 Park
2007/0103411 A1 5/2007 Cok
2007/0103419 A1 5/2007 Uchino
2007/0115221 A1 5/2007 Buchhauser
2007/0126672 A1 6/2007 Tada

(56) References Cited

U.S. PATENT DOCUMENTS

| | | | |
|---|---|---|---|
| 2007/0164664 | A1 | 7/2007 | Ludwicki |
| 2007/0164937 | A1 | 7/2007 | Jung |
| 2007/0164938 | A1 | 7/2007 | Shin |
| 2007/0182671 | A1 | 8/2007 | Nathan |
| 2007/0236134 | A1 | 10/2007 | Ho |
| 2007/0236440 | A1 | 10/2007 | Wacyk |
| 2007/0236517 | A1 | 10/2007 | Kimpe |
| 2007/0241999 | A1 | 10/2007 | Lin |
| 2007/0273294 | A1 | 11/2007 | Nagayama |
| 2007/0285359 | A1 | 12/2007 | Ono |
| 2007/0290957 | A1 | 12/2007 | Cok |
| 2007/0290958 | A1 | 12/2007 | Cok |
| 2007/0296672 | A1 | 12/2007 | Kim |
| 2008/0001525 | A1 | 1/2008 | Chao |
| 2008/0001544 | A1 | 1/2008 | Murakami |
| 2008/0030518 | A1 | 2/2008 | Higgins |
| 2008/0036706 | A1 | 2/2008 | Kitazawa |
| 2008/0036708 | A1 | 2/2008 | Shirasaki |
| 2008/0042942 | A1 | 2/2008 | Takahashi |
| 2008/0042948 | A1 | 2/2008 | Yamashita |
| 2008/0048951 | A1 | 2/2008 | Naugler, Jr. |
| 2008/0055209 | A1 | 3/2008 | Cok |
| 2008/0055211 | A1 | 3/2008 | Ogawa |
| 2008/0074413 | A1 | 3/2008 | Ogura |
| 2008/0088549 | A1 | 4/2008 | Nathan |
| 2008/0088648 | A1 | 4/2008 | Nathan |
| 2008/0111766 | A1 | 5/2008 | Uchino |
| 2008/0116787 | A1 | 5/2008 | Hsu |
| 2008/0117144 | A1 | 5/2008 | Nakano et al. |
| 2008/0136770 | A1 | 6/2008 | Peker |
| 2008/0150845 | A1 | 6/2008 | Ishii |
| 2008/0150847 | A1 | 6/2008 | Kim |
| 2008/0158115 | A1 | 7/2008 | Cordes |
| 2008/0158648 | A1 | 7/2008 | Cummings |
| 2008/0191976 | A1 | 8/2008 | Nathan |
| 2008/0198103 | A1 | 8/2008 | Toyomura |
| 2008/0211749 | A1 | 9/2008 | Weitbruch |
| 2008/0218451 | A1 | 9/2008 | Miyamoto |
| 2008/0231558 | A1 | 9/2008 | Naugler |
| 2008/0231562 | A1 | 9/2008 | Kwon |
| 2008/0231625 | A1 | 9/2008 | Minami |
| 2008/0246713 | A1 | 10/2008 | Lee |
| 2008/0252223 | A1 | 10/2008 | Toyoda |
| 2008/0252571 | A1 | 10/2008 | Hente |
| 2008/0259020 | A1 | 10/2008 | Fisekovic |
| 2008/0290805 | A1 | 11/2008 | Yamada |
| 2008/0297055 | A1 | 12/2008 | Miyake |
| 2009/0033598 | A1 | 2/2009 | Suh |
| 2009/0058772 | A1 | 3/2009 | Lee |
| 2009/0109142 | A1 | 4/2009 | Takahara |
| 2009/0121994 | A1 | 5/2009 | Miyata |
| 2009/0146926 | A1 | 6/2009 | Sung |
| 2009/0160743 | A1 | 6/2009 | Tomida |
| 2009/0174628 | A1 | 7/2009 | Wang |
| 2009/0184901 | A1 | 7/2009 | Kwon |
| 2009/0195483 | A1 | 8/2009 | Naugler, Jr. |
| 2009/0201281 | A1 | 8/2009 | Routley |
| 2009/0206764 | A1 | 8/2009 | Schemmann |
| 2009/0207160 | A1 | 8/2009 | Shirasaki |
| 2009/0213046 | A1 | 8/2009 | Nam |
| 2009/0244046 | A1 | 10/2009 | Seto |
| 2009/0262047 | A1 | 10/2009 | Yamashita |
| 2010/0004891 | A1 | 1/2010 | Ahlers |
| 2010/0026725 | A1 | 2/2010 | Smith |
| 2010/0039422 | A1 | 2/2010 | Seto |
| 2010/0039458 | A1 | 2/2010 | Nathan |
| 2010/0045646 | A1 | 2/2010 | Kishi |
| 2010/0045650 | A1 | 2/2010 | Fish |
| 2010/0060911 | A1 | 3/2010 | Marcu |
| 2010/0073335 | A1 | 3/2010 | Min |
| 2010/0073357 | A1 | 3/2010 | Min |
| 2010/0079419 | A1 | 4/2010 | Shibusawa |
| 2010/0085282 | A1 | 4/2010 | Yu |
| 2010/0103160 | A1 | 4/2010 | Jeon |
| 2010/0134469 | A1 | 6/2010 | Ogura |
| 2010/0134475 | A1 | 6/2010 | Ogura |
| 2010/0165002 | A1 | 7/2010 | Ahn |
| 2010/0194670 | A1 | 8/2010 | Cok |
| 2010/0207960 | A1 | 8/2010 | Kimpe |
| 2010/0225630 | A1 | 9/2010 | Levey |
| 2010/0251295 | A1 | 9/2010 | Amento |
| 2010/0277400 | A1 | 11/2010 | Jeong |
| 2010/0315319 | A1 | 12/2010 | Cok |
| 2011/0050870 | A1 | 3/2011 | Hanari |
| 2011/0063197 | A1 | 3/2011 | Chung |
| 2011/0069051 | A1 | 3/2011 | Nakamura |
| 2011/0069089 | A1 | 3/2011 | Kopf |
| 2011/0069096 | A1 | 3/2011 | Li |
| 2011/0074750 | A1 | 3/2011 | Leon |
| 2011/0074762 | A1 | 3/2011 | Shirasaki |
| 2011/0149166 | A1 | 6/2011 | Botzas |
| 2011/0169798 | A1 | 7/2011 | Lee |
| 2011/0175895 | A1 | 7/2011 | Hayakawa |
| 2011/0181630 | A1 | 7/2011 | Smith |
| 2011/0199395 | A1 | 8/2011 | Nathan |
| 2011/0227964 | A1 | 9/2011 | Chaji |
| 2011/0242074 | A1 | 10/2011 | Bert |
| 2011/0273399 | A1 | 11/2011 | Lee |
| 2011/0279488 | A1 | 11/2011 | Nathan |
| 2011/0292006 | A1 | 12/2011 | Kim |
| 2011/0293480 | A1 | 12/2011 | Mueller |
| 2012/0056558 | A1 | 3/2012 | Toshiya |
| 2012/0062565 | A1 | 3/2012 | Fuchs |
| 2012/0262184 | A1 | 10/2012 | Shen |
| 2012/0299970 | A1 | 11/2012 | Bae |
| 2012/0299973 | A1 | 11/2012 | Jaffari |
| 2012/0299978 | A1 | 11/2012 | Chaji |
| 2013/0002527 | A1 | 1/2013 | Kim |
| 2013/0027381 | A1 | 1/2013 | Nathan |
| 2013/0057595 | A1 | 3/2013 | Nathan |
| 2013/0112960 | A1 | 5/2013 | Chaji |
| 2013/0135272 | A1 | 5/2013 | Park |
| 2013/0162617 | A1 | 6/2013 | Yoon |
| 2013/0201223 | A1 | 8/2013 | Li |
| 2013/0241813 | A1 | 9/2013 | Tanaka |
| 2013/0309821 | A1 | 11/2013 | Yoo |
| 2013/0321671 | A1 | 12/2013 | Cote |
| 2014/0015824 | A1 | 1/2014 | Chaji |
| 2014/0022289 | A1 | 1/2014 | Lee |
| 2014/0043316 | A1 | 2/2014 | Chaji |
| 2014/0055500 | A1 | 2/2014 | Lai |
| 2014/0111567 | A1 | 4/2014 | Nathan |
| 2016/0275860 | A1 | 9/2016 | Wu |

FOREIGN PATENT DOCUMENTS

| | | |
|---|---|---|
| CA | 2 249 592 | 7/1998 |
| CA | 2 368 386 | 9/1999 |
| CA | 2 242 720 | 1/2000 |
| CA | 2 354 018 | 6/2000 |
| CA | 2 432 530 | 7/2002 |
| CA | 2 436 451 | 8/2002 |
| CA | 2 438 577 | 8/2002 |
| CA | 2 463 653 | 1/2004 |
| CA | 2 498 136 | 3/2004 |
| CA | 2 522 396 | 11/2004 |
| CA | 2 443 206 | 3/2005 |
| CA | 2 472 671 | 12/2005 |
| CA | 2 567 076 | 1/2006 |
| CA | 2526436 | 2/2006 |
| CA | 2 526 782 | 4/2006 |
| CA | 2 541 531 | 7/2006 |
| CA | 2 550 102 | 4/2008 |
| CA | 2 773 699 | 10/2013 |
| CN | 1381032 | 11/2002 |
| CN | 1448908 | 10/2003 |
| CN | 1623180 A | 6/2005 |
| CN | 1682267 A | 10/2005 |
| CN | 1758309 A | 4/2006 |
| CN | 1760945 | 4/2006 |
| CN | 1886774 | 12/2006 |
| CN | 1897093 A | 1/2007 |
| CN | 101164377 A | 4/2008 |
| CN | 101194300 A | 6/2008 |

(56) References Cited

FOREIGN PATENT DOCUMENTS

| | | | |
|---|---|---|---|
| CN | 101449311 | | 6/2009 |
| CN | 101615376 | | 12/2009 |
| CN | 102656621 | | 9/2012 |
| CN | 102725786 | A | 10/2012 |
| EP | 0 158 366 | | 10/1985 |
| EP | 1 028 471 | | 8/2000 |
| EP | 1 111 577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| EP | 2395499 | A1 | 12/2011 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-229513 | | 8/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-045648 | | 2/2004 |
| JP | 2004-145197 | | 5/2004 |
| JP | 2004-287345 | | 10/2004 |
| JP | 2005-057217 | | 3/2005 |
| JP | 2007-065015 | | 3/2007 |
| JP | 2007-155754 | | 6/2007 |
| JP | 2008-102335 | | 5/2008 |
| JP | 4-158570 | | 10/2008 |
| JP | 2003-195813 | | 7/2013 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/066249 | A1 | 8/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO/2005/034072 | A1 | 4/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander : "Pixel circuits and drive schemes for glass and elastic AMOLED displays"; dated Jul. 2005 (9 pages).

Alexander : "Unique Electrical Measurement Technology for Compensation, Inspection, and Process Diagnostics of AMOLED HDTV"; dated May 2010 (4 pages).

Ashtiani : "AMOLED Pixel Circuit With Electronic Compensation of Luminance Degradation"; dated Mar. 2007 (4 pages).

Chaji : "A Current-Mode Comparator for Digital Calibration of Amorphous Silicon AMOLED Displays"; dated Jul. 2008 (5 pages).

Chaji : "A fast settling current driver based on the CCII for AMOLED displays"; dated Dec. 2009 (6 pages).

Chaji : "A Low-Cost Stable Amorphous Silicon AMOLED Display with Full V~T- and V~O~L~E—D Shift Compensation"; dated May 2007 (4 pages).

Chaji : "A low-power driving scheme for a-Si:H active-matrix organic light-emitting diode displays"; dated Jun. 2005 (4 pages).

Chaji : "A low-power high-performance digital circuit for deep submicron technologies"; dated Jun. 2005 (4 pages).

Chaji : "A novel a-Si:H AMOLED pixel circuit based on short-term stress stability of a-Si:H TFTs"; dated Oct. 2005 (3 pages).

Chaji : "A Novel Driving Scheme and Pixel Circuit for AMOLED Displays"; dated Jun. 2006 (4 pages).

Chaji : "A Novel Driving Scheme for High Resolution Large-area a-Si:H AMOLED displays"; dated Aug. 2005 (3 pages).

Chaji : "A Stable Voltage-Programmed Pixel Circuit for a-Si:H AMOLED Displays"; dated Dec. 2006 (12 pages).

Chaji : "A Sub-μA fast-settling current-programmed pixel circuit for AMOLED displays"; dated Sep. 2007.

Chaji : "An Enhanced and Simplified Optical Feedback Pixel Circuit for AMOLED Displays"; dated Oct. 2006.

Chaji : "Compensation technique for DC and transient instability of thin film transistor circuits for large-area devices"; dated Aug. 2008.

Chaji : "Driving scheme for stable operation of 2-TFT a-Si AMOLED pixel"; dated Apr. 2005 (2 pages).

Chaji : "Dynamic-effect compensating technique for stable a-Si:H AMOLED displays"; dated Aug. 2005 (4 pages).

(56) References Cited

OTHER PUBLICATIONS

Chaji : "Electrical Compensation of OLED Luminance Degradation"; dated Dec. 2007 (3 pages).
Chaji : "eUTDSP: a design study of a new VLIW-based DSP architecture"; dated May 2003 (4 pages).
Chaji : "Fast and Offset-Leakage Insensitive Current-Mode Line Driver for Active Matrix Displays and Sensors"; dated Feb. 2009 (8 pages).
Chaji : "High Speed Low Power Adder Design With a New Logic Style: Pseudo Dynamic Logic (SDL)"; dated Oct. 2001 (4 pages).
Chaji : "High-precision, fast current source for large-area current-programmed a-Si flat panels"; dated Sep. 2006 (4 pages).
Chaji : "Low-Cost AMOLED Television with IGNIS Compensating Technology"; dated May 2008 (4 pages).
Chaji : "Low-Cost Stable a-Si:H AMOLED Display for Portable Applications"; dated Jun. 2006 (4 pages).
Chaji : "Low-Power Low-Cost Voltage-Programmed a-Si:H AMOLED Display"; dated Jun. 2008 (5 pages).
Chaji : "Merged phototransistor pixel with enhanced near infrared response and flicker noise reduction for biomolecular imaging"; dated Nov. 2008 (3 pages).
Chaji : "Parallel Addressing Scheme for Voltage-Programmed Active-Matrix OLED Displays"; dated May 2007 (6 pages).
Chaji : "Pseudo dynamic logic (SDL): a high-speed and low-power dynamic logic family"; dated 2002 (4 pages).
Chaji : "Stable a-Si:H circuits based on short-term stress stability of amorphous silicon thin film transistors"; dated May 2006 (4 pages).
Chaji : "Stable Pixel Circuit for Small-Area High-Resolution a-Si:H AMOLED Displays"; dated Oct. 2008 (6 pages).
Chaji : "Stable RGBW AMOLED display with OLED degradation compensation using electrical feedback"; dated Feb. 2010 (2 pages).
Chaji : "Thin-Film Transistor Integration for Biomedical Imaging and AMOLED Displays"; dated 2008 (177 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0-1903, dated Apr. 8, 2013, (9 pages).
European Supplementary Search Report for Application No. EP 04 78 6662 dated Jan. 19, 2007 (2 pages).
Extended European Search Report for Application No. 11 73 9485.8 dated Aug. 6, 2013 (14 pages).
Extended European Search Report for Application No. EP 09 73 3076.5, dated Apr. 27, (13 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Extended European Search Report for Application No. EP 10834297 dated Oct. 27, 2014 (6 pages).
Fossum, Eric R.. "Active Pixel Sensors: Are CCD's Dinosaurs?" SPIE: Symposium on Electronic Imaging. Feb. 1, 1993 (13 pages).
Goh , "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2007/000652 dated Jul. 25, 2007.
International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2014/060959, dated Aug. 28, 2014, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, dated Dec. 3, 2002, (4 pages).
International Written Opinion for Application No. PCT/CA2004/001742, Canadian Patent Office, dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Canadian Intellectual Property Office, dated Sep. 11, 2013; (5 pages).
Jafarabadiashtiani : "A New Driving Method for a-Si AMOLED Displays Based on Voltage Feedback"; dated 2005 (4 pages).
Kanicki, J., "Amorphous Silicon Thin-Film Transistors Based Active-Matrix Organic Light-Emitting Displays." Asia Display: International Display Workshops, Sep. 2001 (pp. 315-318).
Karim, K. S., "Amorphous Silicon Active Pixel Sensor Readout Circuit for Digital Imaging." IEEE: Transactions on Electron Devices. vol. 50, No. 1, Jan. 2003 (pp. 200-208).
Lee : "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).

(56) References Cited

OTHER PUBLICATIONS

Liu, P. , Innovative Voltage Driving Pixel Circuit Using Organic Thin-Film Transistor for AMOLEDs, Journal of Display Technology, vol. 5, Issue 6, Jun. 2009 (pp. 224-227).
Ma E Y: "organic light emitting diode/thin film transistor integration for foldable displays" dated Sep. 15, 1997(4 pages).
Matsueda y : "35.1: 2.5-in. AMOLED with Integrated 6-bit Gamma Compensated Digital Data Driver"; dated May 2004.
Mendes E., "A High Resolution Switch-Current Memory Base Cell." IEEE: Circuits and Systems. vol. 2, Aug. 1999 (pp. 718-721).
Nathan A. , "Thin Film imaging technology on glass and plastic" ICM 2000, proceedings of the 12 international conference on microelectronics, dated Oct. 31, 2001 (4 pages).
Nathan , "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan : "Backplane Requirements for active Matrix Organic Light Emitting Diode Displays,"; dated 2006 (16 pages).
Nathan : "Call for papers second international workshop on compact thin-film transistor (TFT) modeling for circuit simulation"; dated Sep. 2009 (1 page).
Nathan : "Driving schemes for a-Si and LTPS AMOLED displays"; dated Dec. 2005 (11 pages).
Nathan : "Invited Paper: a-Si for AMOLED—Meeting the Performance and Cost Demands of Display Applications (Cell Phone to HDTV)"; dated 2006 (4 pages).
Office Action in Japanese patent application No. JP2012-541612 dated Jul. 15, 2014. (3 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati : "Comparison of a 17 b multiplier in Dual-rail domino and in Dual-rail D L (D L) logic styles"; dated 2002 (4 pages).
Safavian : "3-TFT active pixel sensor with correlated double sampling readout circuit for real-time medical x-ray imaging"; dated Jun. 2006 (4 pages).
Safavian : "A novel current scaling active pixel sensor with correlated double sampling readout circuit for real time medical x-ray imaging"; dated May 2007 (7 pages).
Safavian : "A novel hybrid active-passive pixel with correlated double sampling CMOS readout circuit for medical x-ray imaging"; dated May 2008 (4 pages).
Safavian : "Self-compensated a-Si:H detector with current-mode readout circuit for digital X-ray fluoroscopy"; dated Aug. 2005 (4 pages).
Safavian : "TFT active image sensor with current-mode readout circuit for digital x-ray fluoroscopy [5969D-82]"; dated Sep. 2005 (9 pages).
Safavian : "Three-TFT image sensor for real-time digital X-ray imaging"; dated Feb. 2, 2006 (2 pages).
Singh, , "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler , System Considerations for RGBW OLED Displays, Journal of the SID 14/1, 2006, pp. 37-48.
Stewart M. , "polysilicon TFT technology for active matrix oled displays" IEEE transactions on electron devices, vol. 48, No. 5, dated May 2001 (7 pages).
Vygranenko : "Stability of indium-oxide thin-film transistors by reactive ion beam assisted deposition"; dated 2009.
Wang : "Indium oxides by reactive ion beam assisted evaporation: From material study to device application"; dated Mar. 2009 (6 pages).
Yi He , "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).
International Search Report for Application No. PCT/IB2014/060879, Canadian Intellectual Property Office, dated Jul. 17, 2014 (3 pages).
Extended European Search Report for Application No. EP 14158051.4, dated Jul. 29, 2014, (4 pages).
Office Action in Chinese Patent Invention No. 201180008188.9, dated Jun. 4, 2014 (17 pages) (w/English translation).
International Search Report for Application No. PCT/IB/2014/066932 dated Mar. 24, 2015.
Written Opinion for Application No. PCT/IB/2014/066932 dated Mar. 24, 2015.
Extended European Search Report for Application No. EP 11866291.5, dated Mar. 9, 2015, (9 pages).
Extended European Search Report for Application No. EP 14181848.4, dated Mar. 5, 2015, (8 pages).
Office Action in Chinese Patent Invention No. 201280022957.5, dated Jun. 26, 2015 (7 pages).
Extended European Search Report for Application No. EP 13794695.0, dated Dec. 18, 2015, (9 pages).
Extended European Search Report for Application No. EP 16157746.5, dated Apr. 8, 2016, (11 pages).
Extended European Search Report for Application No. EP 16192749.6, dated Dec. 15, 2016, (17 pages).
International Search Report for Application No. PCT/IB/2016/054763 dated Nov. 25, 2016 (4 pages).
Written Opinion for Application No. PCT/IB/2016/054763 dated Nov. 25, 2016 (9 pages).

* cited by examiner

CORRECTION FOR LOCALIZED PHENOMENA IN AN IMAGE ARRAY

CROSS REFERENCE TO RELATED APPLICATION

This application is a continuation of U.S. patent application Ser. No. 14/561,697, filed Dec. 5, 2014, now allowed, which claims the benefit of U.S. Provisional Application No. 61/912,926, filed Dec. 4, 2013, each of which is hereby incorporated by reference in its entirety.

TECHNICAL FIELD

The present invention relates to semiconductor arrays such as those used in display panels and more specifically to a system to compensate for localized phenomena in OLED displays.

BACKGROUND

Displays can be created from an array of light emitting devices each controlled by individual circuits (i.e., pixel circuits) having transistors for selectively controlling the circuits to be programmed with display information and to emit light according to the display information. Thin film transistors ("TFTs") fabricated on a substrate can be incorporated into such displays. TFTs tend to demonstrate non-uniform behavior across display panels and over time as the displays age. Compensation techniques can be applied to such displays to achieve image uniformity across the displays and to account for degradation in the displays as the displays age.

Some schemes for providing compensation to displays to account for variations across the display panel and over time utilize monitoring systems to measure time dependent parameters associated with the aging (i.e., degradation) of the pixel circuits. The measured information can then be used to inform subsequent programming of the pixel circuits so as to ensure that any measured degradation is accounted for by adjustments made to the programming. Such monitored pixel circuits may require the use of additional transistors and/or lines to selectively couple the pixel circuits to the monitoring systems and provide for reading out information. The incorporation of additional transistors and/or lines may undesirably decrease pixel-pitch (i.e., "pixel density").

Another source of distortion may be localized phenomena such as the content of the data displayed by a pixel array, temperature effects, pressure on the screen or incidental light. For example, higher localized temperature may result in a distorted higher input data into the compensation equation which distorts the correction for aging effects. Thus, the input data for pixels may require additional compensation for effects based on the localized phenomena on a pixel display in obtaining accurate aging compensation for such pixels.

SUMMARY

One disclosed example is a method of compensating for localized phenomena in a display device including an array of pixels and a controller for adjusting content data signals for the array of pixels to compensate for aging of the pixels in the array. A parameter of at least one of the pixels in the array is measured. The effect of a localized phenomena using the parameter is determined. A characteristic is measured for at least one of the pixels in the array. The measured characteristic is adjusted to reduce the effect of the localized phenomena. An adjusted aging compensation value is calculated based on the adjusted measured characteristic. The aging compensation value is applied to a data content signal to at least one of the pixels.

Another disclosed example is a display device including a display array having a plurality of pixels. The plurality of pixels each include a write input to write data content and a read input. A controller is coupled to the display array. The controller is operable to measure a parameter of at least one of the pixels in the array via the read input of the at least one of the pixels. The controller is operable to determine the effect of a localized phenomena on the pixel using the parameter. The controller is operable to measure a characteristic for at least one of the pixels in the array via the read input of the at least one of the pixels. The controller is operable to adjust the measured characteristic to reduce the effect of the localized phenomena. The controller is operable to calculate an adjusted aging compensation value based on the adjusted measured characteristic. The controller is operable to apply the aging compensation value to a data content signal to the write input of at least one of the pixels.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The foregoing and other advantages of the invention will become apparent upon reading the following detailed description and upon reference to the drawings.

Figure 1:
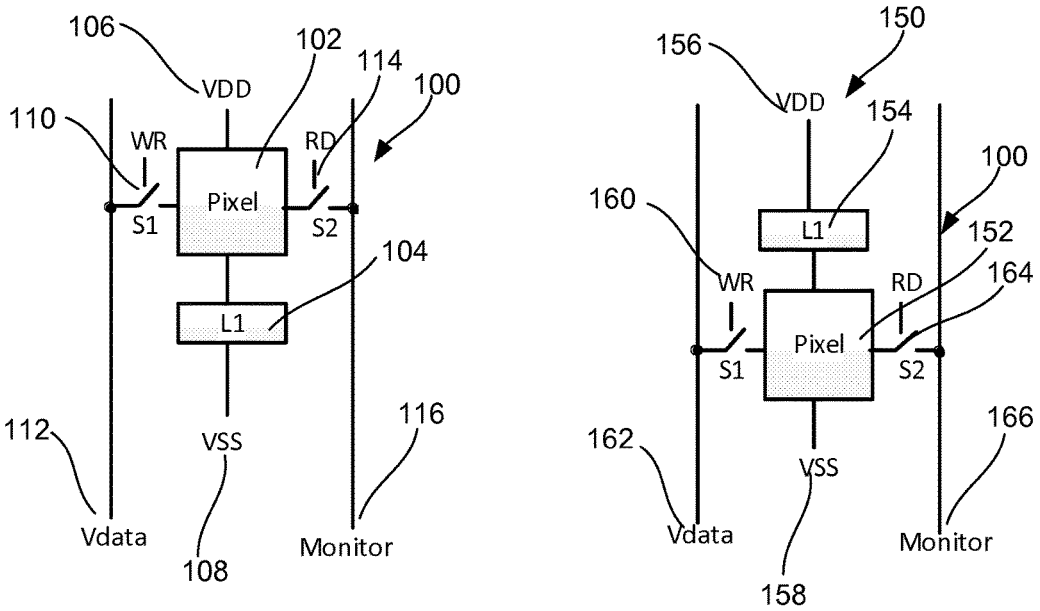
FIG. 1 shows two different pixel architectures used in semiconductor display arrays.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 shows two pixel architectures for a semiconductor display array, such as an array used in an OLED type displays. FIG. 1 shows a first pixel architecture 100 that includes a driving circuit 102, a load 104 that is coupled in series between a voltage supply (VDD) 106 and a voltage supply (VSS) 108. A write switch 110 allows data from an input line 112 to be programmed to the driving circuit 102. A read switch 114 allows a monitor line 116 to read the output from the driving circuit 102. In this example, the load 104 is a load that is driven by the pixel or resets the internal pixel circuit. The driving circuit 102 is the driving or amplifying part of the circuit that powers the pixel in the display array.

FIG. 1 also shows a second pixel architecture 150 that includes a driving circuit 152, a load 154 that is coupled in series between a voltage source (VDD) 156 and a voltage source (VSS) 158. A write switch 160 allows data from an input line 162 to be programmed to the driving circuit 152. A read switch 164 allows a monitor line 166 to read the output from the driving circuit 152. In this example, the load 154 is a load that is driven by the pixel or resets the internal pixel circuit. The driving circuit 152 is the driving or amplifying part of the circuit that powers the pixel in the display array. In both pixel architectures 100 and 150, the respective input lines 112 and 162 and monitor lines 116 and 166 are coupled to a controller which programs the respective pixels via the input lines 112, 162 controlled by the write switches 110 and 160 and monitors the respective pixels via the monitor lines 116 and 166 controlled by the read switches 114 and 164. In this example, the pixels driven by the drivers 102 and 152 are organic light emitting devices (OLEDs) which may include components such as thin film transistors that may have operating characteristics that change over age.

One method to extend the semiconductor array lifetime and/or improve the array uniformity is external compensation for the effects of aging on OLEDs. In this example, the backplane and load input characteristics for the display array are measured and the backplane and load characteristics data is used to compensate for lifetime and uniformity of the OLEDs by the controller.

Some localized phenomena effects that depend on either the content displayed by the array or localized environmental issues can cause a divergence in the aging compensation function based on the influence of measured input characteristics data. For example, when the semiconductor array is used in a display device, the displayed content on the pixels can affect the voltage distribution or localized temperatures throughout the display. Therefore, if the backplane and load characteristics are measured during the display of different content, the measured characteristics will vary due to localized phenomena. In this case, the compensation is based on accumulated changes in the characteristics, and thus the compensation will diverge over time and cause errors because of the localized display of different content. Another example of localized phenomena may be increased temperature to certain pixels in an array such as exposure to sunlight on one part of the display. The increased temperature from the sunlight may affect the voltage distribution or localized temperatures for pixels in the area exposed to the sunlight and therefore the measured input characteristics will vary for those pixels. Similar to content effects, the compensation is based on accumulated changes in the characteristics, and thus the compensation will diverge over time and cause errors because of the localized temperature effects.

To improve the aging compensation performance, the unwanted effect of localized phenomena may be removed from the extracted characteristics. Three example techniques to determine the effect of localized phenomena using at least one parameter of at least one of the pixels on the array may include: a) modeling based on pixel characteristics; b) use of reference pixels; and c) use of reference loads. Once the effect of localized phenomena is determined, it may be removed from characteristics that are input into the aging compensation equation for the pixels. These techniques to determine the effect of localized phenomena will be described below.

One example technique is using modeling to determine the effect of localized phenomena. In this technique, the pixel characteristics are measured at a few points such as at different input current values. The points may be taken during a time period of device operation that is sufficient to account for the effect of the localized phenomena. Based on the measurement points, the changes in different parameters are calculated. Such parameters may include mobility, threshold voltage, OLED voltage, and OLED off-current. The effect of the localized phenomena is calculated based on simplified models (e.g., temperature variation, voltage distribution, etc.) using the changes in the parameters. The compensation values for localized phenomena are extracted for the array device from the results of the models.

The measured parameter of the display circuit such as the architectures 100 or 150 in FIG. 1 is used to fine tune the calculated localized phenomena. In one example, a parameter that is mainly affected by localized phenomena (e.g., mobility) is selected to estimate the localized phenomena. Then the effect of estimated localized phenomena is calculated on other parameters (e.g., off voltage (threshold voltage shift)) that are measured at different points. The measured points are input to a model to determine the effects of the localized phenomena.

For example, a first order model may suggest that mobility (gain) of a device changes by 5% for every 10° C. Therefore, if the resulting measurements of two points from the pixel characteristics show that the mobility changes by 10% an estimate may be made that the temperature changed by 20° C. Also, knowing the effect of temperature change on the other parameters (e.g., threshold voltage) allows an estimate to be made of how much of the measured changes in the parameters is due to the temperature change (20° C.) and how much is due to aging.

In another example, the rate of change in the parameter may be used to extract the effect of localized phenomena. For example, in case of temperature variation and content dependent voltage redistribution, the changes in the parameter are fast while aging is a very slow process. In one case, a low pass filter may remove all the fast changes in the measurement to eliminate the effect of localized parameters. The filtered characteristic measurement may then be used as an input to the aging compensation algorithm. In another case, a low-pass filter may be employed on the extracted parameters to eliminate the effect of localized phenomena in the form of changes that occur quickly indicating the effect of localized phenomena in contrast with gradually occurring changes that occur as a result of aging.

In another example, the rate of change and dependency of the parameters to the localized phenomena may be used to extract the effect of localized phenomena. The compensation values may be corrected based on the fine-tuned localized phenomena. After estimating the effect of localized phenomena on each parameter from previous steps, this effect may be removed from those parameters by subtracting or dividing the parameters with the estimated effect for example. Then the modified parameter may be used to create the compensation values. For example, the compensation values for threshold voltage shift may be a simple addition of the shift in the extracted parameter to the input signals.

The order of the aforementioned procedure can be changed. Alternatively, only on the measured parameters may be relied upon to calculate the localized phenomena.

Figure 2:
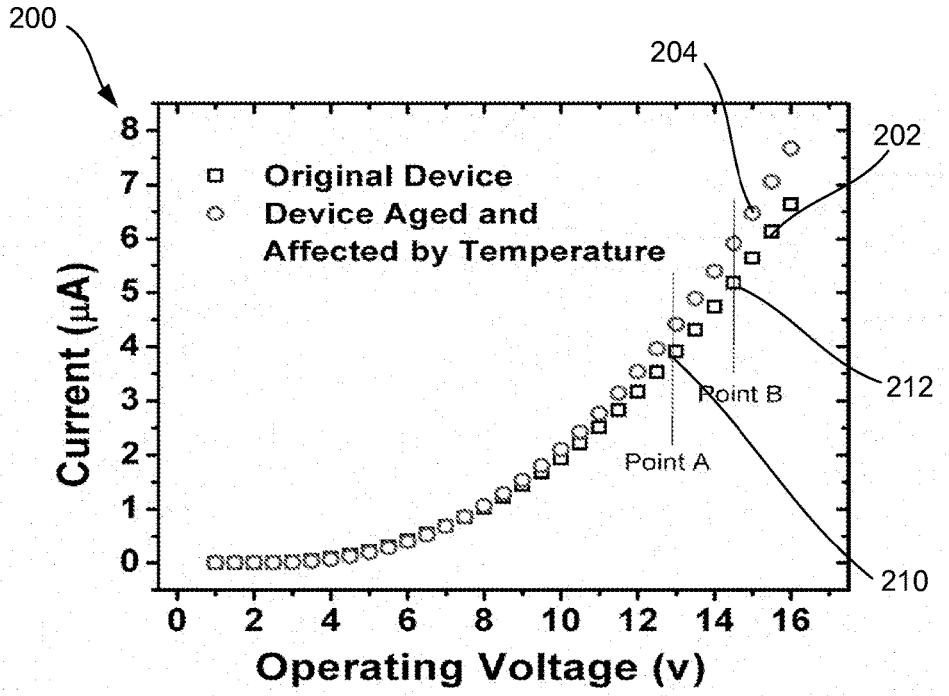
FIG. 2 is a graph of current versus operating voltage for an original device and a device aged and affected by temperature.

FIG. 2 is a graph 200 of current versus operating voltage for an original device and a device after aging and also affected by a localized phenomena such as temperature. A first line 202 shows the plot of current versus operating voltage for an original device. A second line 204 shows the plot of current versus operating voltage for a device affected by aging and temperature. As may be seen in line 204 in FIG. 2, aging and temperature distort the operating characteristics of the device. In this example, the device off voltage is increased by 0.5 V due to aging effects and its gain is increased by 25% due to the localized phenomena of temperature. Thus, due to temperature effect, the affected device has a higher current. The output of the affected device may be compensated for aging based on many different techniques. However, compensation for aging alone would still result in deviation from the original device due to the localized phenomena such as temperature.

To eliminate this effect, two points may be measured for the device to extract the temperature effect based on modeling. The measurement of a device characteristic may then be adjusted from the results of the modeling to eliminate the effect of the temperature. The adjusted measured characteristic may then be input to the aging compensation technique. In this example, a parameter such as the operating voltage measured at a first current (point A) 210 and at a second current (point B) 212. Using a linear model for current-voltage characteristics, the change in the gain may be extracted as 19% and the change in the off voltage as 0.22 V from the two operating voltage points. The determined change in gain is based on the localized phenomena and may then be used to correct the measured input characteristics when the compensation for aging of the pixel device is determined.

However, use of a more sophisticated non-linear model of the current-voltage characteristics based on the two measurements results in the determination of a change in the gain of 24.9% and that the off-voltage is changed by 0.502 V. Thus, depending on the required accuracy and the computation power available, different models may be used to determine the effects of localized phenomena and thus the accuracy of the adjustment of the measured input characteristic to the aging compensation techniques. The model output may be made on more than two parameter points of the device for greater accuracy of the modeling results. The parameter points of each pixel on the array may be measured, or the parameter points of certain selected pixels at predetermined intervals in the array may be measured for purposes of inputs to the model.

Figure 8A:
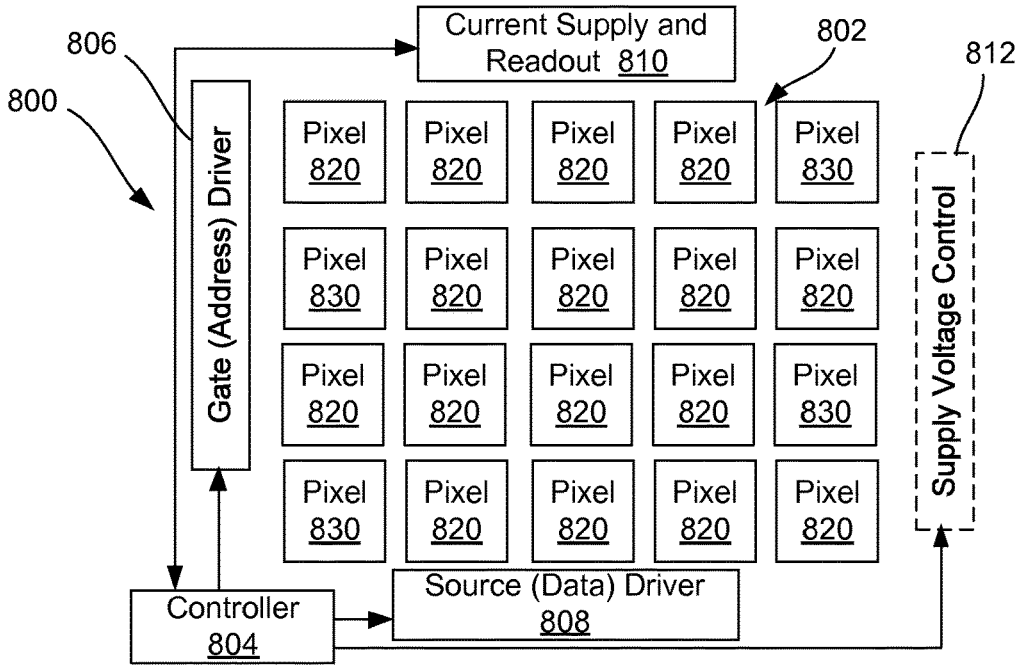
FIG. 8A is a block diagram of a display array including reference pixels for correction for localized phenomena.

A second technique to determine the effect of localized phenomena may be the use of reference pixels. FIG. 8A shows a panel display device 800 which includes a pixel array 802 that is controlled by a controller 804. The controller 804 accesses individual pixels via an address driver 806. Content is displayed on the pixel array 802 via a data driver 808. Current is supplied and read via a current supply and readout unit 810. A supply voltage control 812 regulates the voltage to the pixels in the pixel array 802.

As shown in FIG. 8A, a panel display device 800 may include normal pixels 820 and some reference pixels 830 distributed across the pixel array 802. The normal pixels 820 receive content data inputs from the data driver 808 and display the content. The reference pixels 830 are identical in structure to the normal pixels 820. However, the status of the reference pixels 830 remains the same since such pixels are not coupled to data inputs from a controller 804. Thus, the reference pixels 830 are either not aged or aged with a known state because they are not connected to content data signals. In this example, a parameter of both the normal pixels 820 and the reference pixels 830 are measured in the same way via the current readout 810. The difference in parameter values measured between a reference pixel 830 and a normal pixel 820 in proximity to the reference pixel 830 is associated with the effect of the localized phenomena. For example, the difference between a parameter value of the reference pixel and a normal pixel is indicative of aging effects, since the normal pixel is subject to aging but reference pixel is not. The absolute parameter value after eliminating the difference in parameter values from the normal pixel is indicative of the effect of the localized phenomena since the localized phenomena affects both the normal pixel and a reference pixel in close proximity to the normal pixel.

A reference map may be developed for the entire pixel array 802 based on the measurements from the reference pixels 830 in the pixel array 802. The reference map may then be used to determine the effects of the localized phenomena for each pixel 820 in the pixel array 802.

In one example, the reference map is an interpolation of the measured value for all other pixels based on the reference pixel measurement values. In this case, the measured values of the other pixels are corrected by the reference value associated with that pixel (e.g. the two values are either subtracted or divided). The resulting corrected value is used to adjust the measured characteristic used to calculate an adjusted aging compensation value for a pixel in the array.

In another example, the reference map is an interpolation of the extracted parameters for other pixels based on the reference pixel parameters. The parameters extracted for each pixel based on its own measurement data is tuned by the reference parameter maps (e.g., a model may be used to eliminate the unwanted effects from the extracted parameters).

The reference measurements from the reference pixels 830 may be taken when the display device 800 is either on line or off line. Generally, there are fewer reference pixels than normal pixels since the reference pixels are not coupled to content data inputs. The number of reference pixels therefore limits the display area of the pixels in the array. In this example, there is one reference pixel 830 for four normal pixels 820, but other ratios may be used. The reference pixel measurements are applied for compensation of normal pixels 820 in proximity of the reference pixel 830.

To cover the content lost associated with reference pixels in an array, the adjacent pixels may be used to create the content lost from the reference pixels. In one example shown in FIG. 8B, the pixel array 802 may include a plurality of pixel units such as the reference pixel unit 830 which each contain sub-pixels. As explained above, the reference pixel unit 830 is the same as the normal pixel unit 820 except that some or all of the subpixels in the reference pixel 830 are not coupled to content data signals. Each pixel unit in the example pixel array 802 in FIG. 8A such as the pixel unit 830 has different sub-pixels such as a red pixel 840*a*, a green pixel 840*b*, a blue pixel 840*c* and a white pixel 840*d*. The sub-pixels 840*a*-840*d* may be used to generate color outputs from a normal pixel unit 820. In this example, some of the pixels in the pixel array 802 are reference pixels as shown in FIG. 8A. In such reference pixels such as the reference pixel 830 shown in FIG. 8B, one or more of the sub-pixels are used as reference pixels and the other sub-pixels may create the content of that would be output on the reference sub-pixel if the pixel unit operated normally. In this case, the reference pixel may be one sub-pixel such as the white pixel 840*d*. The red pixel 840*a*, green pixel 840*b* and blue pixel 840*c* may generate the white content for the white pixel 840*d* which is used as a reference pixel and thus does not emit any light.

Figure 3:
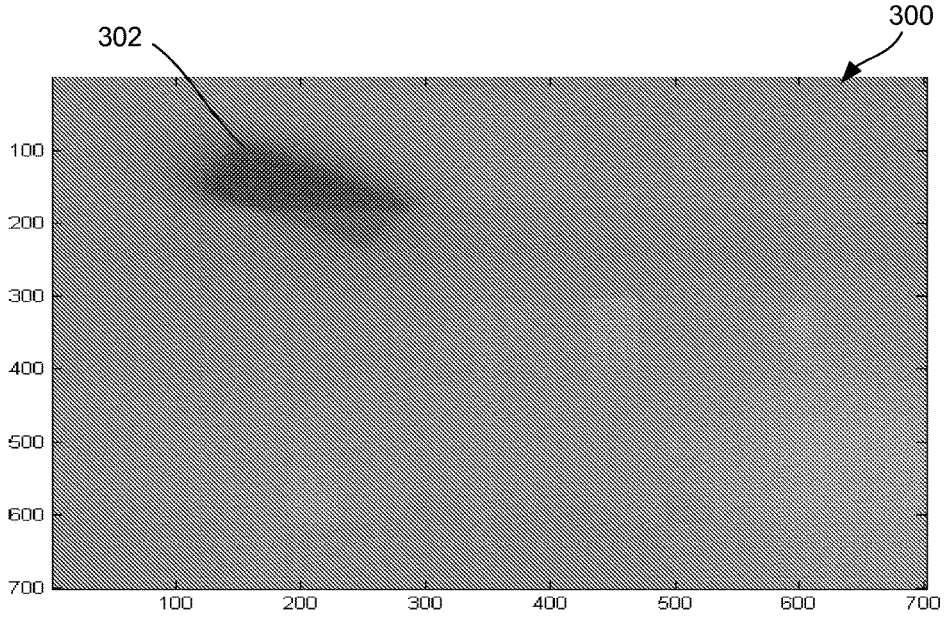
FIG. 3 is a reference map created by interpolation between measured values of reference pixels for localized phenomena from the content of a display.
Figure 4:
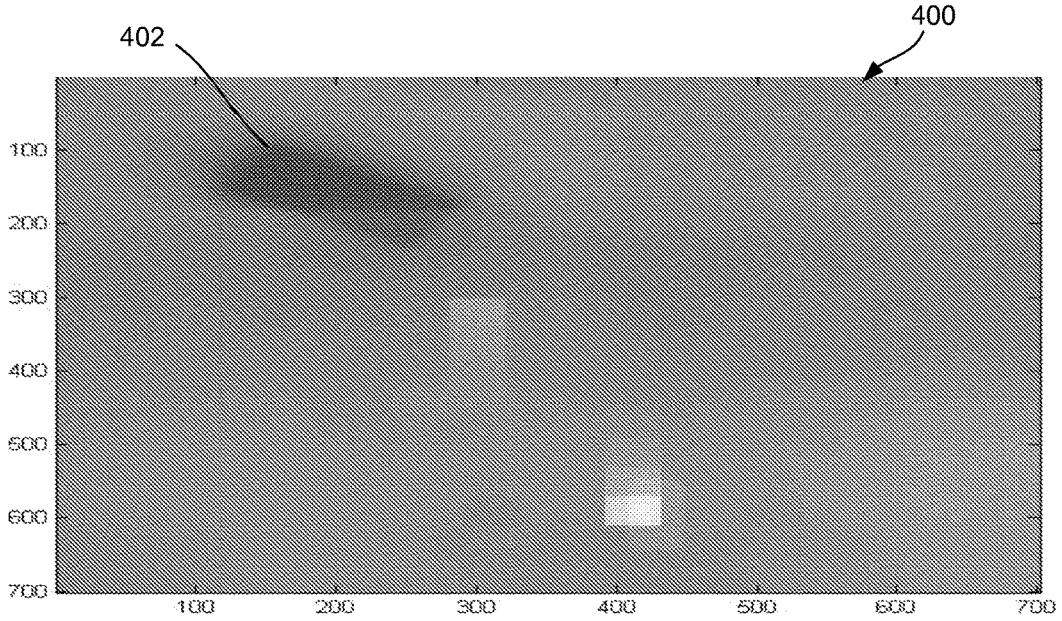
FIG. 4 is a reference map showing the original results of panel measurements including the effect of aging and localized phenomena.
Figure 5:
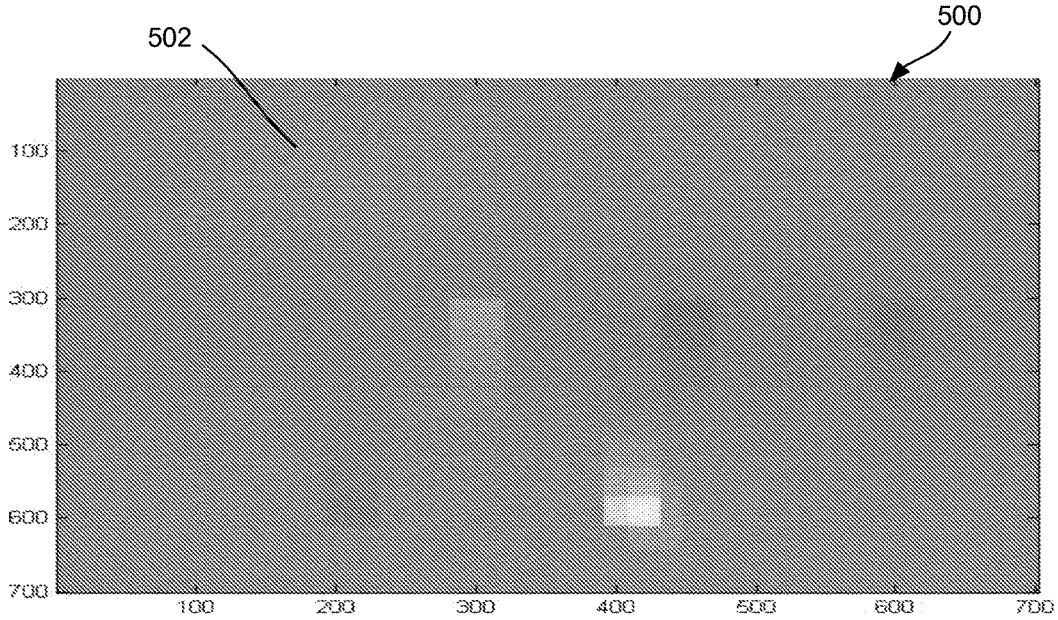
FIG. 5 is a reference map showing aging compensation results after the effect of localized phenomena are removed from the original results of the panel measurement by means of reference pixels, using simple subtraction to eliminate the effect of localized phenomena.

FIGS. 3-5 demonstrate the results of the aging algorithm on a panel with some localized phenomena and the results of using reference pixels to minimize the effect of the localized phenomena. A panel was cooled intentionally at the top-left corner with a heat sink to simulate a localized phenomena, and there were a few images displayed on the panel affecting the voltage redistribution. FIG. 3 is a reference map 300 created by interpolation between measured values of reference pixels for localized phenomena from the content of a display. The reference map 300 includes an area 302 of the localized phenomena that is created by temperatures from the heat sink in proximity to the display.

FIG. 4 shows a reference map 400 that shows the original results of panel measurements including the effect of aging and localized phenomena temperature, voltage redistribution etc.). In this example, the original results include the localized phenomena of temperature in an area 402.

Figure 8B:
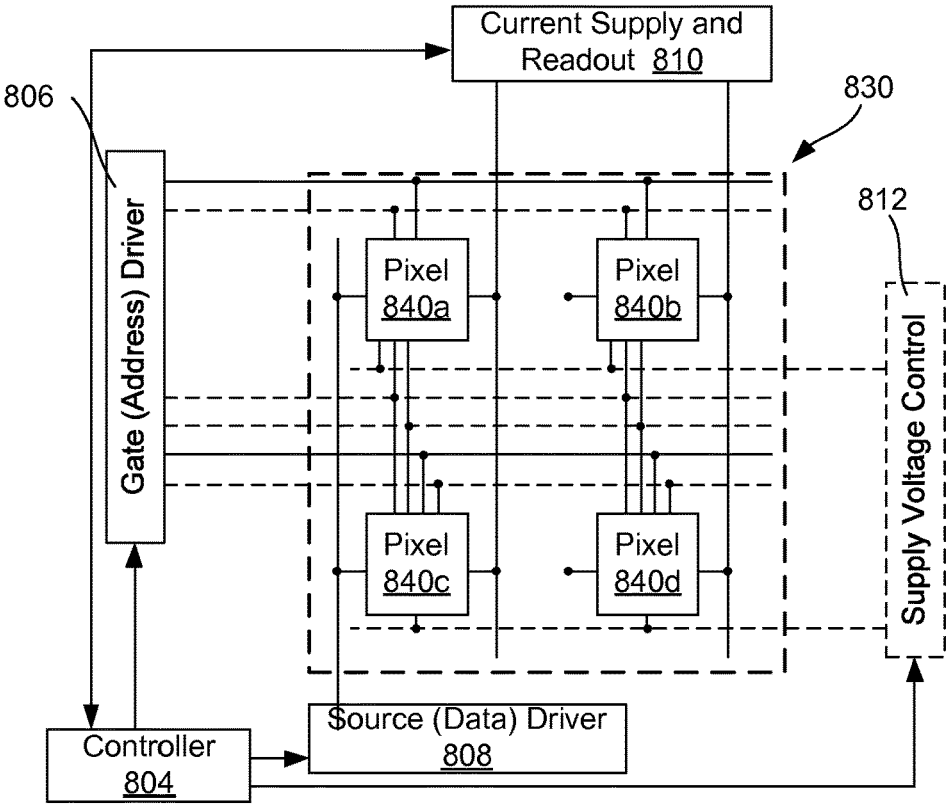
FIG. 8B is a block diagram of a pixel including subpixels that may be used as a reference pixel.

FIG. 5 shows a reference map 500 that shows the aging compensation results after the effect of localized phenomena are removed from the original results of the panel measurement by means of reference pixels such as those shown in FIGS. 8A-8B, using simple subtraction to eliminate the effect of localized phenomena. An area 502 in FIG. 5 may be contrasted to the area 402 in the reference map 400 in FIG. 4 to show that the effects related to localized phenomena have been eliminated.

A third technique to determine the effect of localized phenomena is adding extra load elements to at least some of the pixels in an array to extract the localized phenomena based on measurements from the reference loads. In this technique, the reference load elements are not aged by content stress while the other components of the pixel architecture are aged based on content data written to the pixel. The characteristics of the reference load are compared with the characteristics of the pixel load. Therefore, the differences in the characteristics of the reference load and the pixel load can be associated with the localized phenomena (e.g. voltage redistributions, temperature variation, etc.).

Figure 6:
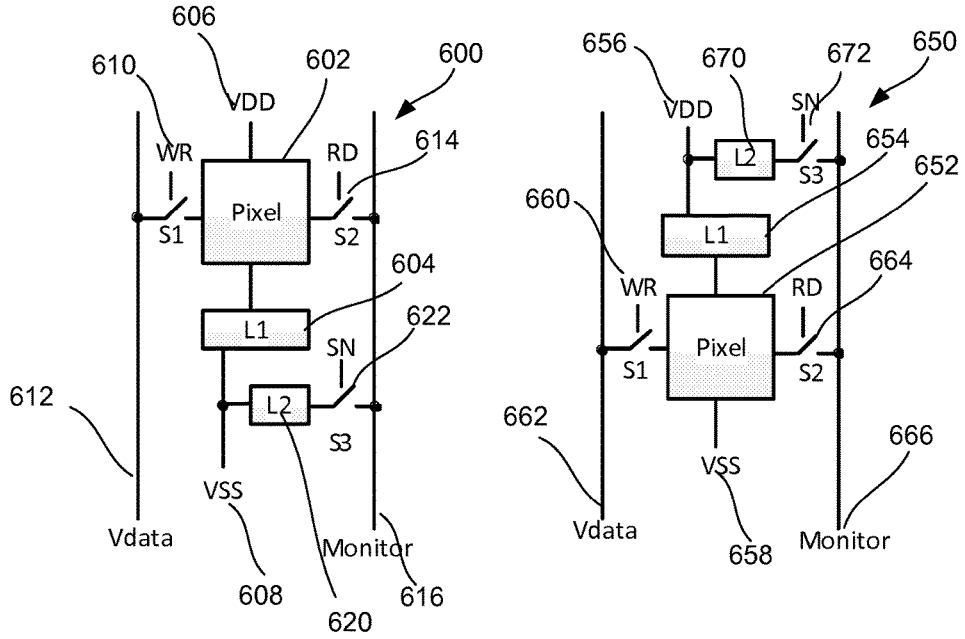
FIG. 6 show two modified pixel structures with reference loads used in semiconductor display arrays for correction for localized phenomena.

FIG. 6 shows two examples of pixel architectures using extra load elements for purposes of compensating for localized phenomena. FIG. 6 shows an example reference load pixel architecture 600 and an alternate reference load pixel architecture 650. The first reference load pixel architecture 600 includes a driving circuit 602 and a pixel load 604 that is coupled in series between a voltage source (VDD) 606 and a voltage source (VSS) 608. A write switch 610 allows data from an input line 612 to be programmed to the driving circuit 602. A read switch 614 allows a monitor line 616 to read the output from the driving circuit 602. In this example, the pixel load 604 is a load that is driven by the pixel or resets the internal pixel circuit. The driver circuit 602 is the driving or amplifying part of the circuit that powers the pixel in the display array. A reference load 620 is also coupled to the voltage ground 608 and a reference switch 622 to the monitor line 616. The reference switch 622 may be controlled by the same signal controlling either the write switch 610 or the read switch 614. Alternatively, a separate measurement line may be used for controlling the reference switch 622 to measure the reference load 620.

The alternate reference pixel architecture 650 includes a driving circuit 652 and a pixel load 654 that is coupled in series between a voltage source 656 and a voltage ground 658. A write switch 610 allows data from an input line 662 to be programmed to the driving circuit 652. A read switch 664 allows a monitor line 666 to read the output from the driver 652. In this example, the load 654 is a load that is driven by the pixel or resets the internal pixel circuit. The driving circuit 652 is the driving or amplifying part of the circuit that powers the pixel in the display array. A reference load 670 is also coupled to the voltage source 656 and a reference switch 672 to the monitor line 616. The reference switch 672 may be controlled by the same signal controlling either the write switch 660 or the read switch 664. Alternatively, a separate measurement line may be used for the reference load 670.

In one example, a reference signal applied to the switch 622 or switch 672 may be either the read signal applied to the respective read switch 614 or 664 to read from the respective pixel drivers 602 and 652. A parameter or characteristic of reference loads 620 or 670 is measured in order to compare parameters or characteristics with elements in the pixel driver. In this example, the reference load may include similar components to the actual pixels on a display such as a driving transistor or a pixel circuit. However, the reference load does not include every component in the actual pixel architecture and therefore does not take up the space of a reference pixel as in the example explained above. During the measuring of the characteristics of the reference loads 620 or 670, the pixel itself may be programmed with the signal off state or if the pixel content has negligible effect on the measurement from the reference load, the pixel may be programmed with its content, and the read signal is off from the respective read switches 614 and 664 being open.

Thus, the characteristics of the reference loads 620 or 670 may be extracted via the respective read lines 616 and 666 in this example. In this case, any change to the power source lines (e.g., VSS or VDD) will be part of the measured data for the reference load. The characteristics of the pixel loads 604 or 654 may be extracted by the respective read lines 616 and 666 in this example. During the extraction, the reference switches 622 or 672 are open, so the reference loads 620 and 670 are not read. The read characteristics of the reference load and the pixel load are compared to determine the effect of the localized phenomena.

In addition, any other localized phenomena may be measured if it affects the reference load. To improve the correction for the effect of localized phenomena on the pixel and the characteristics of the load 604 or 654, different reference load elements may be used. Some of the reference load elements may match the load 604 or 654 and other reference loads may match the pixel driving circuit 602 or 652. In another example, a different reference load may be used for measuring the effect of different localized phenomena. Some or all of the pixels in the display array may have reference load elements depending on the desired accuracy and processing overhead. The reference measurements from the reference load elements may be taken when the display is either on line or off line.

Figure 7:
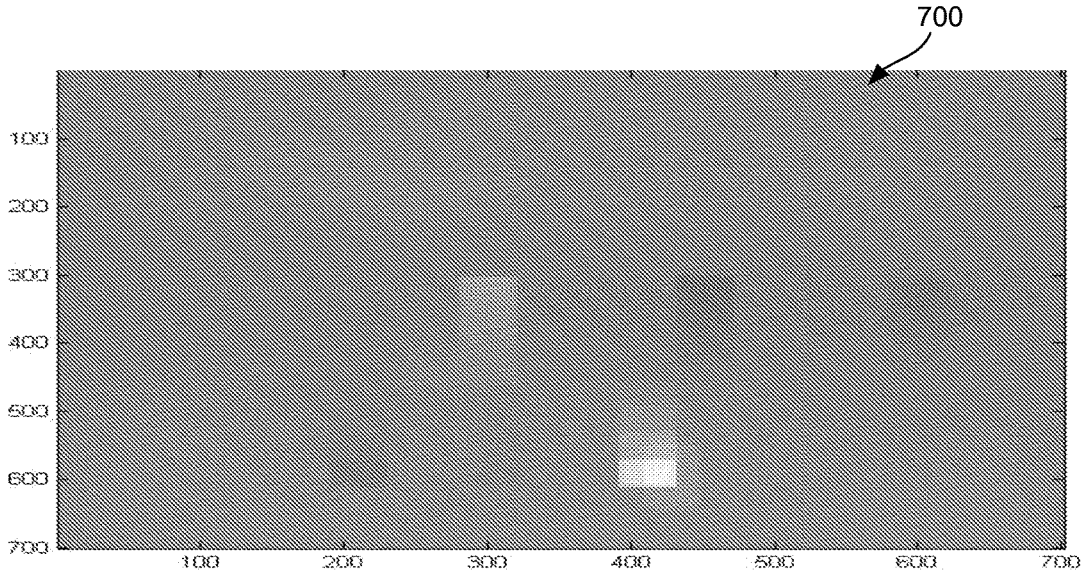
FIG. 7 is a reference map showing aging compensation results after the effect of localized phenomena are removed from the original results of the panel measurement by means of reference loads.

FIG. 7 is a reference graph 700 that shows aging results after the effect of localized phenomena are removed from the original results of the panel measurement by means of reference loads such as by the architectures 600 and 650 in FIG. 6. The reference graph 700 shows the results of using a reference load on the same panel represented in the architectures in FIG. 6. As may be seen by FIG. 7, the results may have higher resolution with less interpolation error since the number of reference loads may be higher resulting in more input data than the smaller amount of data limited by the relatively smaller number of reference pixels without affecting image quality.

Figure 9:
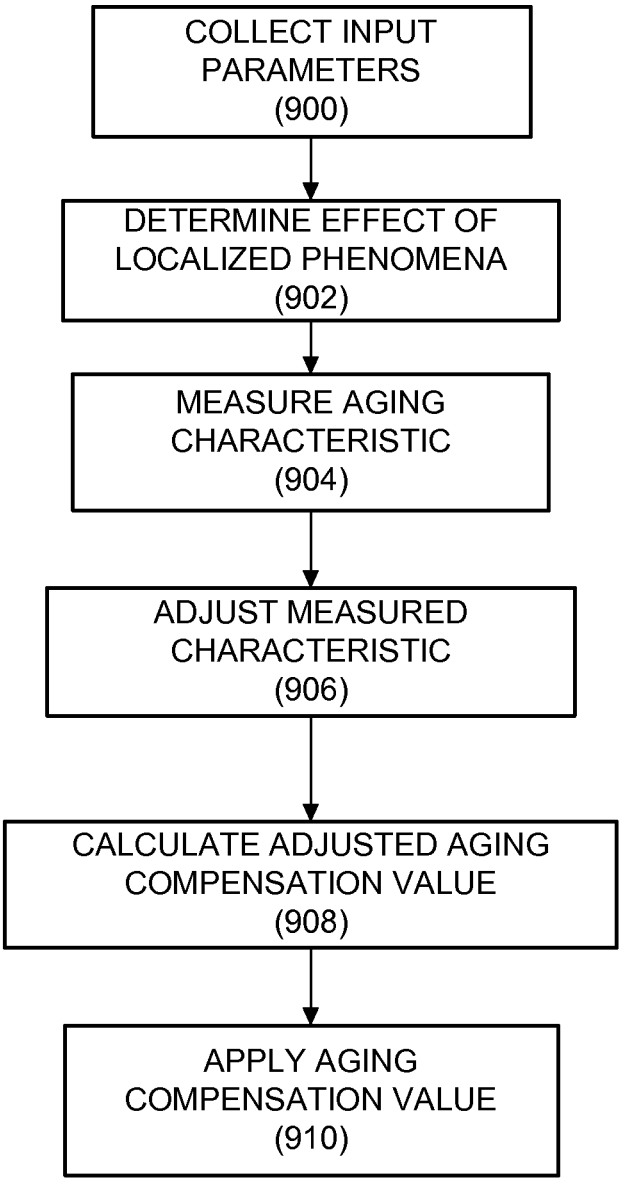
FIG. 9 is a flow diagram of the process to correct for localized phenomena in a semiconductor array display.

FIG. 9 is a flow diagram of the process of compensation for aging as well as localized phenomena in a display array. Initially relevant input parameters are collected (900). The relevant input parameters may be points from pixel characteristics or measurements of characteristics from reference pixels or a reference load. The effect of the localized phenomena is determined based on the relevant input parameter or parameters (902). A characteristic is then measured from at least one pixel in the array for aging compensation (904). The measured characteristic from a pixel is then adjusted to reduce the effect of the localized phenomena (906). The adjusted measured characteristic is then input into a compensation equation to calculate an adjusted aging compensation value (908). The compensation value is then applied to adjust a data content signal for a pixel to compensate for the effects of aging (910).

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

The invention claimed is:

1. A method of compensating for localized phenomena in a display device including an array of pixels and a controller for adjusting content data signals for the array of pixels using original aging compensation values to compensate for aging of the pixels in the array, said method comprising;

determining an effect of a localized phenomena on an effected pixel in the array of pixels based on a change in a parameter of the effected pixel;

adjusting the original aging compensation value as a function of the change in the parameter associated with the localized phenomena to reduce the effect of the localized phenomena on the effected pixel;

applying the adjusted aging compensation value to a content data signal for the effected pixel; and applying one of the original aging compensation values to a content data signal for each pixel not effected by the localized phenomena.

2. The method of claim 1, wherein at least one of the pixels in the array of pixels is a reference pixel in proximity to the effected pixel, and wherein determining the effect of the localized phenomena includes comparing the parameter of the reference pixel with the same parameter of the effected pixel.

3. The method of claim 2, wherein the reference pixel includes a first subpixel that accepts a data content signal, and a second subpixel that is not coupled to a data content signal, wherein the parameter of the reference pixel is measured from the second subpixel.

4. The method of claim 3, wherein the first subpixel generates data content in place of the second subpixel.

5. The method of claim 2, wherein the parameter of the reference pixel is interpolated for comparison with the same measured parameter of the effected pixel.

6. The method of claim 1, wherein at least one of the pixels in the array of pixels includes a reference load, and wherein determining the effect of the localized phenomena includes comparing the parameter of the reference load with the same parameter of the effected pixel.

7. The method of claim 6, wherein the measured parameter of the reference load is interpolated for the comparison of the same parameter for a second pixel in proximity to the pixel including the reference load.

8. The method of claim 1, wherein determining the effect of the localized phenomena includes inputting the parameter at one point and the parameter at a second point in a model of the current voltage characteristics to calculate the effect of the localized phenomena.

9. The method of claim 1, wherein determining the effect of the localized phenomena includes filtering out changes that occur quickly between values of the parameter during different times.

10. A display device comprising:

a display array including a plurality of pixels, the plurality of pixels each including a write input to write data content and a read input; and a controller coupled to the display array, the controller operable to:

adjust content data signals for the array of pixels using an aging compensation value for each pixel;

determine an effect of a localized phenomena on an effected pixel in the array of pixels based on a change in a parameter of the effected pixel;

adjust the aging compensation value as a function of the change in the parameter associated with the localized phenomena to reduce the effect of the localized phenomena on the effected pixel;

apply the adjusted aging compensation value to a content data signal to the effected pixel; and applying one of the original aging compensation values to a content data signal for each pixel not effected by the localized phenomena.

11. The display device of claim 10, wherein at least one of the pixels is a reference pixel in proximity to the effected pixel, and wherein the controller determines the effect of the localized phenomena by comparing the parameter of the reference pixel with the same parameter of the effected pixel.

12. The display device of claim 11, wherein the reference pixel includes a first subpixel that accepts a data content signal, and a second subpixel that is not coupled to a data content signal, wherein the parameter of the reference pixel is measured from the second subpixel.

13. The display device of claim 12, wherein the first subpixel generates data content in place of the second subpixel.

14. The display device of claim 11, wherein the parameter of the reference pixel is interpolated for comparison with the same parameter of the effected pixel in proximity to the reference pixel.

15. The display device of claim 10, wherein at least one of the pixels includes a reference load, and wherein the controller determines the effect of the localized phenomena by comparing the parameter of the reference load with the same parameter of the effected pixel.

16. The display device of claim 15, wherein the measured parameter of the reference load is interpolated for the comparison of the same parameter for a second pixel in proximity to the pixel including the reference load.

17. The display device of claim 10, wherein the controller determines the effect of the localized phenomena by inputting the parameter at one point and the parameter at a second point in a model of current voltage characteristics to calculate the effect of the localized phenomena.

18. The display device of claim 10, wherein determining the effect of the localized phenomena includes filtering out changes that occur quickly between values of the measured parameter during different times.

19. The display device of claim 10, wherein the localized phenomena is selected from the group consisting of content displayed by the pixels from data content signals, and temperature.

20. The display device of claim 10, wherein the parameter is selected from the group consisting of mobility, threshold voltage, organic light emitting device (OLED) voltage, and OLED off-current.

* * * * *